United States Patent [19]

Jagst

[11] Patent Number: 4,547,935

[45] Date of Patent: Oct. 22, 1985

[54] WASTE GRID FOR A TEXTILE FIBER PROCESSING MACHINE

[75] Inventor: Peter Jagst, Monchen-Gladbach, Fed. Rep. of Germany

[73] Assignee: Trützschler GmbH & Co. KG, Monchen-Gladbach, Fed. Rep. of Germany

[21] Appl. No.: 646,934

[22] Filed: Sep. 4, 1984

[30] Foreign Application Priority Data

Sep. 17, 1983 [DE] Fed. Rep. of Germany ..... 3333618

[51] Int. Cl.[4] ..... D01B 1/44

[52] U.S. Cl. ..... 19/93; 19/95; 19/200

[58] Field of Search ..... 19/93, 95, 200

[56] References Cited

U.S. PATENT DOCUMENTS

| | | | |
|---|---|---|---|
| 1,076,715 | 10/1913 | Onge | 19/95 |
| 2,421,478 | 6/1947 | Blewett | 19/93 |
| 2,681,478 | 6/1954 | Shaw et al. | 19/95 |
| 2,836,858 | 6/1958 | Szaloki | 19/95 X |
| 3,136,004 | 6/1964 | Smith | 19/95 |
| 3,559,804 | 2/1971 | Lytton | 19/95 X |

FOREIGN PATENT DOCUMENTS

| | | | |
|---|---|---|---|
| 1284843 | 1/1962 | France | 19/95 |

*Primary Examiner*—Louis K. Rimrodt
*Attorney, Agent, or Firm*—Spencer & Frank

[57] ABSTRACT

A textile fiber processing machine includes a rotary cylinder having circumferential areas for engaging and circumferentially entraining fiber material introduced into the machine; and a waste grid situated adjacent to and radially spaced from, a circumferential portion of the cylinder. The waste grid allows waste from the fiber material to pass through. The waste grid has a plurality of grid bars supported parallel to one another. Adjoining grid bars define grid slots through which waste may pass. Each grid bar has a bar face oriented towards the cylinder and a free end portion. The bar faces are inclined towards the cylinder for abutting fiber material thrown towards the waste grid by the cylinder and for allowing waste material, after impingement thereon, to slide on the bar face towards and off the free end portion.

8 Claims, 7 Drawing Figures

FIG. 3a
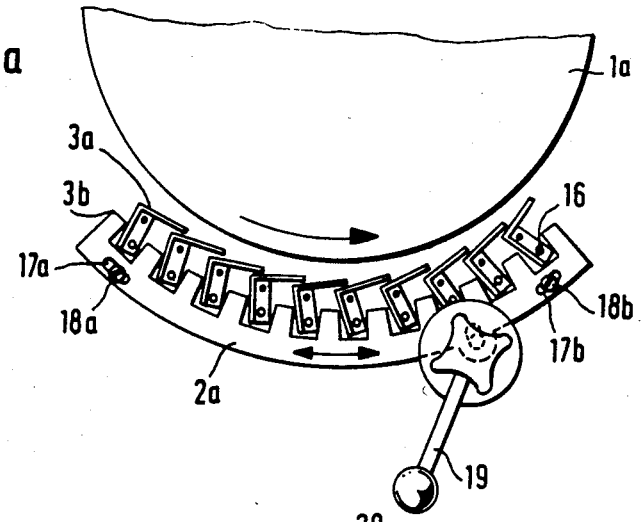
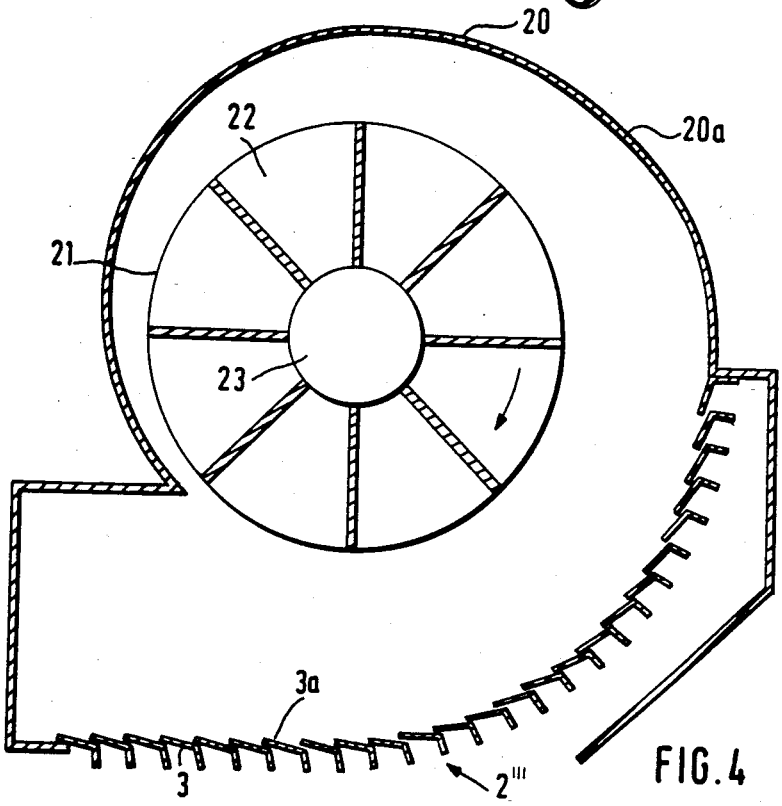
FIG. 4

WASTE GRID FOR A TEXTILE FIBER PROCESSING MACHINE

BACKGROUND OF THE INVENTION

The invention relates to a casing for a cylinder of a textile fiber processing machine which prepares the textile material for spinning, and is particularly concerned with a waste grid of cleaning machines for fiber material, for example, cotton wherein, for separating waste, at least one beater cylinder is rotated in the immediate vicinity of the grid.

In a known grid, the fiber material impinges, in the direction of rotation of the cylinder, on the grid bar edges which constitute a resistance for the inflowing fiber material. In this manner, waste such as trash, shell fragments or leaf portions is removed effectively from the cotton fibers. It is a disadvantage of these arrangements that a substantial stress is imparted on the fiber material as it is hurdled against the grid bar edges.

SUMMARY OF THE INvENTION

It is an object of the invention to provide an improved casing for a cylinder or cylinders of a textile fiber processing machine which ensures a highly satisfactory cleaning and dust removal as well as a gentle handling of the fibers.

This object and others to become apparent as the specification progresses, are accomplished by the invention, according to which, briefly stated, the grid bar faces oriented towards the associated cylinder are inclined towards the cylinder in the rotational direction thereof, whereby the fiber material impinges on the grid bar faces and slides off the free end thereof.

By virtue of the above-defined inclination of the grid bar faces, the fiber material no longer impinges on the grid bar edges but collides with the grid bar faces and is driven therefrom in the direction of the free end of the grid bar faces. The fiber material slides off the faces of impingement and lands on the face of the successive grid bar. This arrangement thus ensures that the fiber material does not engage an edge but a face whereby a gentle treatment of the fiber material is ensured. The fiber material is progressively advanced over the serially arranged inclined grid faces in an intermittent manner. During this occurrence, the fiber material is thrown back and forth between the beater cylinder and the grid so that a pulsating motion of the material is effected. By means of the beater cylinder and by virtue of an impingement on the grid bar faces, effected particularly by a centrifugal force, dust and waste are loosened from the fiber material and are removed through the slots between the grid bar faces. In this manner, there is effected a superior cleaning and dust removal as well as a gentle treatment of the fiber material.

Preferably, the free end portion (slide-off end) of each grid bar face overlaps one portion of the successive grid bar faces as viewed in the direction of rotation of the cylinder. This arrangement ensures that the edge at the beginning of each grid bar face is covered so as to effectively prevent the fiber material from impinging thereon.

Preferably, each grid bar face forms an obtuse angle with the grid bar base. Preferably, the grid bars are adjustable about a horizontal axis to thus vary the inclination of the grid bar faces. In this manner, the reciprocal effect of the beater cylinder and the grid faces and thus the cleaning and dust removal as well as the stress on the fiber material may be tuned to one another in an optimal manner.

Expediently, the free end of each grid face is bent towards the cylinder generally in the radial direction thereof. In this manner, the fiber material is at least partially guided substantially radially in the direction of the beater cylinder and also, a certain resistance to the material flow is generated. Advantageously, sheet metal bars with rounded edges are used as grid bars, particularly the grid bar faces. Such components may be manufactured in a simple manner.

According to a preferred embodiment of the invention, each grid bar face has a series of narrow slots which are open at the end of the grid bar face. This results in a comb-like configuration of each grid bar face. In this construction the fiber material may itself, in a self-cleaning manner, remove the tufts jammed in the grid slots. The fiber material is thrown against the combs by the centrifugal force of the beater cylinders. Preferably the width of the slots is smaller than the tuft size so that waste, trash, dust and the like may pass through the slots defined by the comb teeth, while fiber material is retained thereby.

BRIEF DESCRIPTION OF THE DRAWING

FIG. 3*a* is a schematic elevational view of a further detail of the invention.

FIG. 4 is a schematic sectional elevational view of still a further embodiment of the invention.

DESCRIPTION OF THE PREFERRED EMBODIMENTS

Figures 1, 1A, 1B:
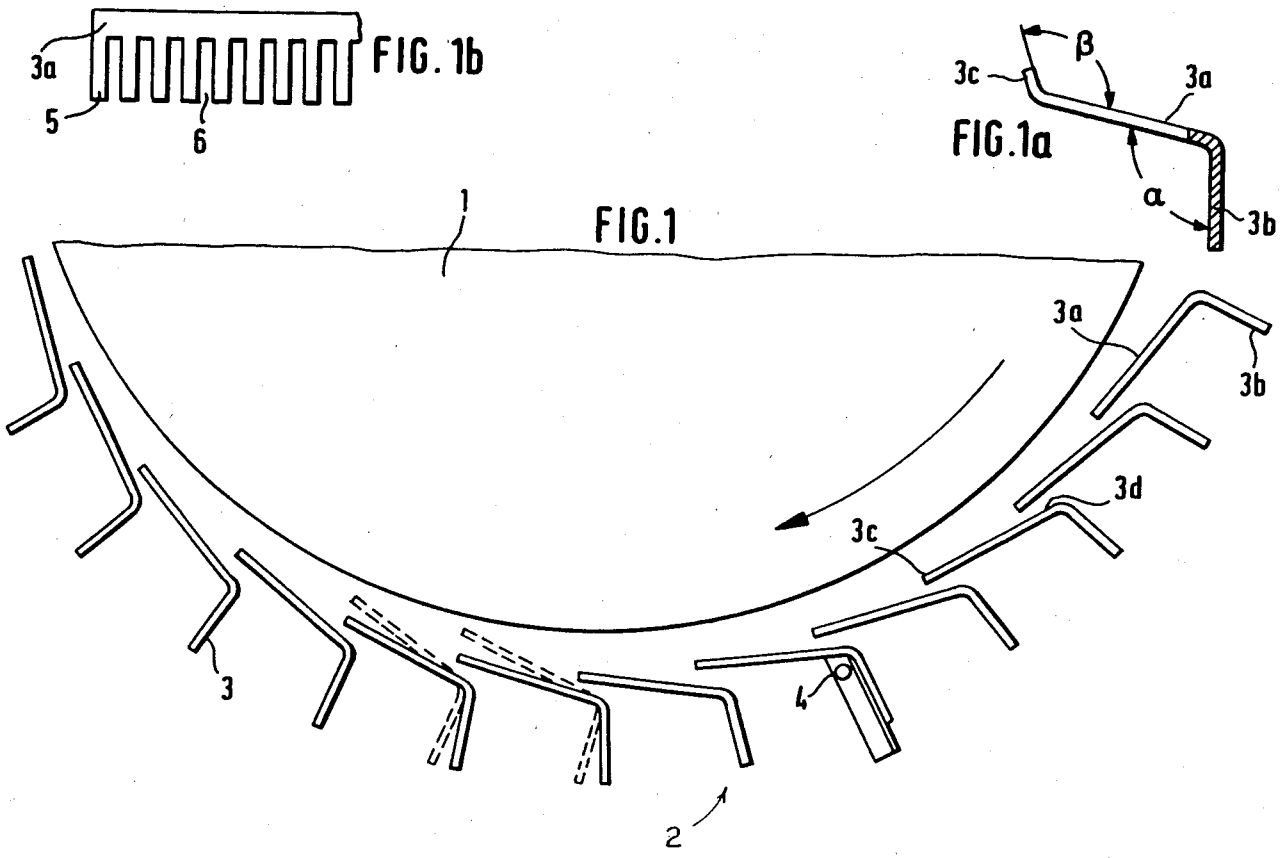
FIG. 1 is a schematic sectional elevational view of a preferred embodiment of the invention.
FIG. 1*a* is a sectional elevational view of an element of the structure shown in FIG. 1.
FIG 1*b* is a top plan view of the component shown in FIG. 1*a*.

Turning to FIG. 1, there is schematically shown a beater cylinder 1 of a cleaner which may be, for example, a "porcupine" beater. Underneath the beater cylinder there is arranged a grid 2 formed of a plurality of grid bars 3. Each grid bar 3 is a bent sheet metal member and has an upper grid bar face 3*a* oriented towards the beater 1 and a grid bar base 3*b*. The upper grid bar face 3*a* of each grid bar 3 is, as viewed in the direction of rotation of the beater cylinder 1, inclined towards the beater cylinder 1. The fiber material (not shown is thrown by the beater cylinder 1 towards the grid 2 and impinges on the grid bar face 3*a* and then slides off the free end 3*c* thereof. The free end 3*c* (slide-off end) of each grid bar face 3*a* overlaps the initial zone 3*d* of the grid bar face 3*a* of the respective successive grid bar 3. The latter is adjustable by pivotal motion about a horizontal axis 4, as indicated by the phantom line position shown for two grid bars.

As seen in FIG. 1*a*, the grid bar face 3*a* forms an obtuse angle $\alpha$ with the grid bar base 3*b*. The free end 3*c* of the grid bar face 3*a* is bent upwardly to an extent that it forms an angle $\beta$ of approximately 135° with the grid bar face 3*a*.

Turning now to FIG. 1*b*, the upper grid bar face 3*a* has a series of parallel spaced teeth 5 defining narrow slots 6 which are open at the free end of the grid bar face 3*a*. The width of the slots 6 of approximately 2 to 5 mm is smaller than the size of the fiber tufts (not shown) which are thus retained by the teeth 5. The freed waste such as trash and the like and dust passes through the slots 6 and is subsequently removed, for example, by suction.

Figure 2:
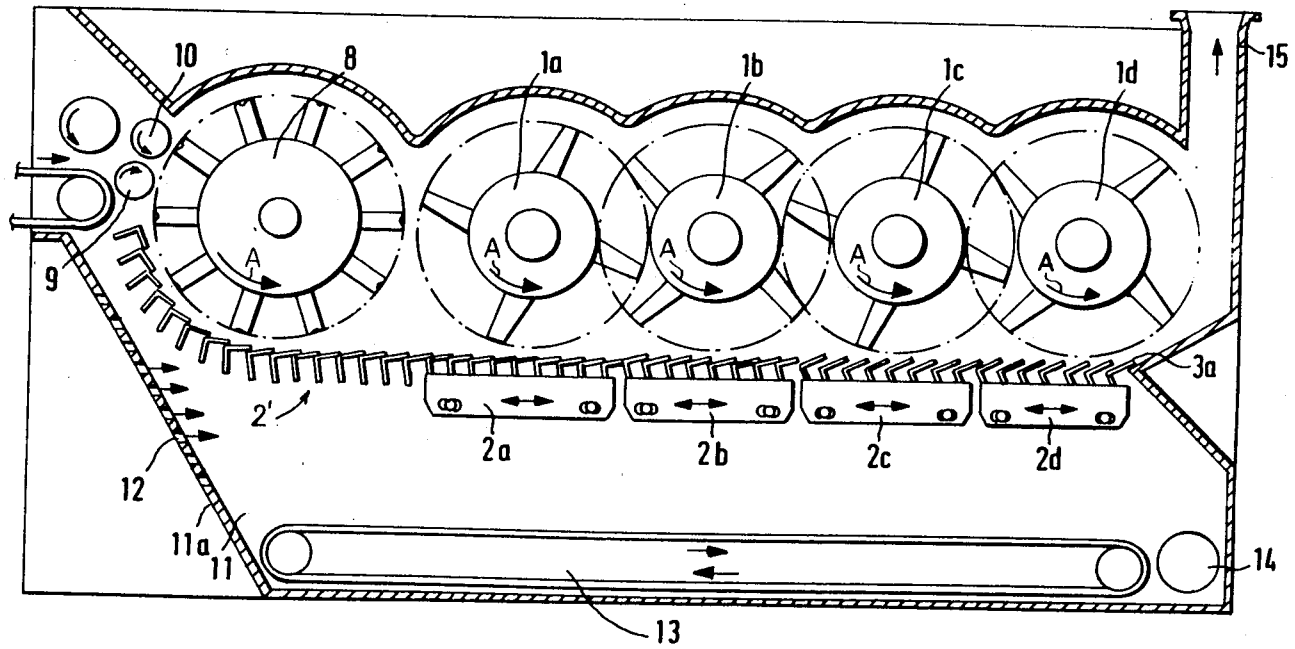
FIG. 2 is a schematic sectional side elevational view of another preferred embodiment of the invention.

Turning now to FIG. 2, there is schematically shown a cleaning machine with a porcupine beater 8 revolving, for example, with 840 rpm, with which there are associated two feed rollers 9 and 10 for advancing the fiber material. The porcupine beater 8 is followed downstream by four beater cylinders 1*a* through 1*d* which, similarly to the porcupine beater 8, rotate counterclockwise as indicated by the arrows A. The beater fingers of the beater cylinders 1*a*–1*d* have a negative orientation, that is, they point against the direction of rotation. The rpm may be adjustable; for example, the beater cylinder 1*a* could revolve with an rpm of 750 whereas the successive beater cylinders 1*b*–1*d* may have a progressively increasing rpm. This rpm augmentation effects a progressive cleaning of the fiber tufts so that initially coarse waste becomes progressively finer.

Underneath the porcupine beater 8 and the beater cylinders 1*a* through 1*d* there is provided a grid 2' which is formed of a plurality of independently settable sections 2*a*–2*d*, as shown in FIG. 3*a*. The inclination of the upper grid bar faces 3*a* with respect to the cylinders 8 and 1*a*–1*d* may be varied in order to achieve, in case of different degrees of soiling of the cotton, an optimal cleaning and dust removal. Such an arrangement in particular takes into account the progressive cleaning and the type of waste. The upper grid bar faces 3*a* are, as viewed in the direction of rotation of the cylinders, inclined towards the closest cylinder. Underneath the grid 2' there is provided a waste collecting chamber 11. The lateral wall 11*a* of the waste collecting chamber 11, at the side of the feed rollers 9 and 10, is provided with openings 12 for the intake of fresh air. In the lower zone of the waste collecting chamber 11 there is provided an endless conveyor belt 13 for removing heavy impurities. At the end of the conveyor belt 13 a suction opening is provided which is coupled to an evacuating device (not illustrated). The suction opening 14 may be under vacuum continuously particularly in case dust-laden air is to be removed. The tuft outlet opening of the cleaning machine is designated at 15.

Figure 3:
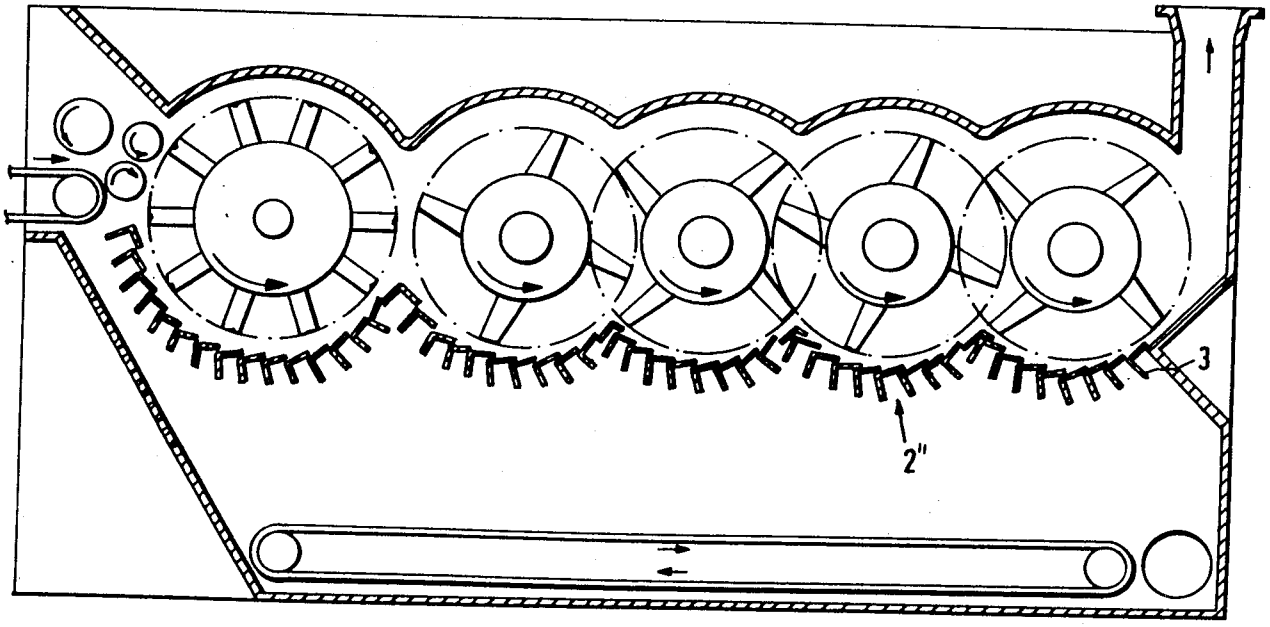
FIG. 3 is a schematic sectional side elevational view of still another preferred embodiment of the invention.

Turning now to FIG. 3, there is shown a cleaning and dust removing machine which is similar to that illustrated in FIG. 2 wherein, however, underneath each cylinder 8 and 1*a*–1*d* the grid bars 3 are arranged such that in each instance a curved grid 2'' is formed, conforming to the circumference of the respective beater.

According to FIG. 3*a*, the grid bar bases 3*b* are supported in recesses of a section 2*a* about pivots 16. The section 2*a* has two slots 17*a* and 17*b* through which pass respective screws 18*a* and 18*b*. The section 2*a* is movable by a shifting device 19 in directions shown by the double-headed arrow, whereby the grid bar bases 3*b* change their angular position by rotating about respective pivots 16 and thus the inclination of the grid bar faces 3*a* is varied with respect to the cylinder 1*a*.

Turning now to FIG. 4, the blower conveyor shown therein has a spiral outlet housing 20 which is spaced from the circumference of an impeller 21 which, in essence, has a planar carrier disc 22 and a carrier ring 23. The impeller 21 has an rpm of approximately 1500 rpm up to a maximum of 3000 rpm. The housing or casing face 20 is formed at least in part as a grid 2''' having grid bars 3 between which there are defined grid slots extending parallel to the axis of the impeller 21. The upper grid bar faces 3*a* of the grid bars 3 are, as viewed in the direction of rotation of the impeller, inclined towards the impeller 21.

It will be understood that the above description of the present invention is susceptible to various modifications, changes and adaptations, and the same are intended to be comprehended within the meaning and range of equivalents of the appended claims.

What is claimed is:

1. In a textile fiber processing machine including a rotary cylinder having circumferential areas for engaging and circumferentially entraining fiber material introduced into the machine; a waste grid situated adjacent to and radially spaced from, a circumferential portion of the cylinder; said waste grid allowing waste from the fiber material to pass through; the improvement in said waste grid comprising a plurality of grid bars supported parallel to one another; adjoining grid bars defining grid slots through which waste may pass; each grid bar having a bar face oriented towards said cylinder and a free end portion; said bar faces being inclined towards said cylinder for abutting fiber material thrown towards said waste grid by said cylinder and for allowing waste material, after impingement thereon, to slide on said bar face towards and off said free end portion.

2. A textile fiber processing machine as defined in claim 1, wherein the free end portion of each grid bar is in an overlapping, spaced relationship with the bar face of a successive grid bar.

3. A textile fiber processing machine as defined in claim 1, wherein each grid bar has a bar base connected to an end of the bar face remote from said free end portion thereof; said bar face and said bar base being inclined at an obtuse angle to one another.

4. A textile fiber processing machine as defined in claim 1, further comprising means for pivotally supporting each said grid bar for pivotal motion about a horizontal axis for adjusting the inclination of said bar face.

5. A textile fiber processing machine as defined in claim 1, wherein the free end portion is bent out of a plane defining said bar face and is oriented generally radially towards said cylinder.

6. A textile fiber processing machine as defined in claim 1, wherein the grid bars are sheet metal bars of rounded edges.

7. A textile fiber processing machine as defined in claim 1, wherein each grid face has a comb-like structure formed of teeth and gaps defined therebetween; said gaps being open-ended at the free end portion of the respective bar face.

8. A textile fiber processing machine as defined in claim 7, wherein each gap has a width measured parallel to the circumferential direction of said cylinder; said width being smaller than the expected smallest size of fiber tufts of the fiber material for preventing a passage thereof through said gaps.

* * * * *